US007870625B2

(12) United States Patent
Omar

(10) Patent No.: US 7,870,625 B2
(45) Date of Patent: Jan. 18, 2011

(54) MAT FOR CHILD DEVELOPMENT

(76) Inventor: Melanee Omar, 2975 Country Road W14, Cresco, IA (US) 52136

( * ) Notice: Subject to any disclaimer, the term of this patent is extended or adjusted under 35 U.S.C. 154(b) by 8 days.

(21) Appl. No.: 12/108,652

(22) Filed: Apr. 24, 2008

(65) Prior Publication Data

US 2008/0263766 A1 Oct. 30, 2008

Related U.S. Application Data

(60) Provisional application No. 60/913,548, filed on Apr. 24, 2007.

(51) Int. Cl.
*A47C 15/00* (2006.01)
*G04B 47/00* (2006.01)

(52) U.S. Cl. ..... 5/655; 5/925; 368/10

(58) Field of Classification Search ..... 5/417, 5/420, 655, 925; 368/10
See application file for complete search history.

(56) References Cited

U.S. PATENT DOCUMENTS 5,072,429 A * 12/1991 Mair ..... 368/10
5,269,033 A * 12/1993 Reid et al. ..... 5/417
5,740,567 A * 4/1998 Mitchell ..... 5/420
5,971,761 A * 10/1999 Tillman, Sr. ..... 434/81
6,181,647 B1 * 1/2001 Tipton et al. ..... 368/10
6,236,621 B1 * 5/2001 Schettino ..... 368/10
6,783,822 B1 * 8/2004 Faouaz ..... 428/34.1
6,940,783 B2 * 9/2005 Fox et al. ..... 368/10
2004/0172763 A1 * 9/2004 Sachs et al. ..... 5/656
2007/0245491 A1 * 10/2007 Korbonski ..... 5/417
2007/0268115 A1 * 11/2007 Holmes ..... 340/309.3
2008/0263766 A1 * 10/2008 Omar ..... 5/417

* cited by examiner

*Primary Examiner*—Michael Trettel

(57) ABSTRACT

A child management system is provided for entertaining, calming, and affecting the proper development of a child. The child management system comprises a mat having a top and bottom surface, a timing device mounted on the mat and set for a pre-determined amount of time, and a pressure sensitive sensor embedded within the mat electronically connected to the timing device such that the timing device counts down a predetermined amount of time while a child is activating the pressure sensitive sensor. The system further comprises a speaker mounted on the mat that is electronically connected to the sensor wherein the type of audio sound emitted by the speaker is a function of a child activating the pressure sensitive sensor. Additionally, a control device is connected to the timing device and speaker to set the pre-determined amount of time and control the audio sound emitted by the speaker.

4 Claims, 2 Drawing Sheets

MAT FOR CHILD DEVELOPMENT

CROSS REFERENCE TO RELATED APPLICATION

This application claims the benefit of U.S. Provisional Application No. 60/913,548 filed Apr. 24, 2007.

BACKGROUND OF THE INVENTION

This invention is directed to a mat used for child development. More specifically, this invention is directed to a mat having a timing unit.

A "time-out" has become a popular disciplinary practice for adjusting child behavior. Typically, when a child misbehaves or throws a tantrum they are instructed to go to their room or a designated area to calm or affect their behavior. In other situations, children are instructed to do homework or read for a designated period of time. While timing devices are known, a need still exists for an entertaining and/or calming device that assists in affecting a child's development. Therefore, there is a need in the art for a device that addresses these needs.

SUMMARY OF THE INVENTION

A child management system for entertaining, calming, and affecting the proper development of a child. The child management system comprises a mat having a top and bottom surface, a timing device mounted on the mat and set for a pre-determined amount of time, and a pressure sensitive sensor embedded within the mat electronically connected to the timing device such that the timing device counts down a predetermined amount of time while a child is activating the pressure sensitive sensor. The system further comprises a speaker mounted on the mat that is electronically connected to the sensor wherein the type of audio sound emitted by the speaker is a function of a child activating the pressure sensitive sensor. Additionally, a control device is connected to the timing device and speaker to set the pre-determined amount of time and control the audio sound emitted by the speaker.

DETAILED DESCRIPTION OF THE INVENTION

Figure 1:
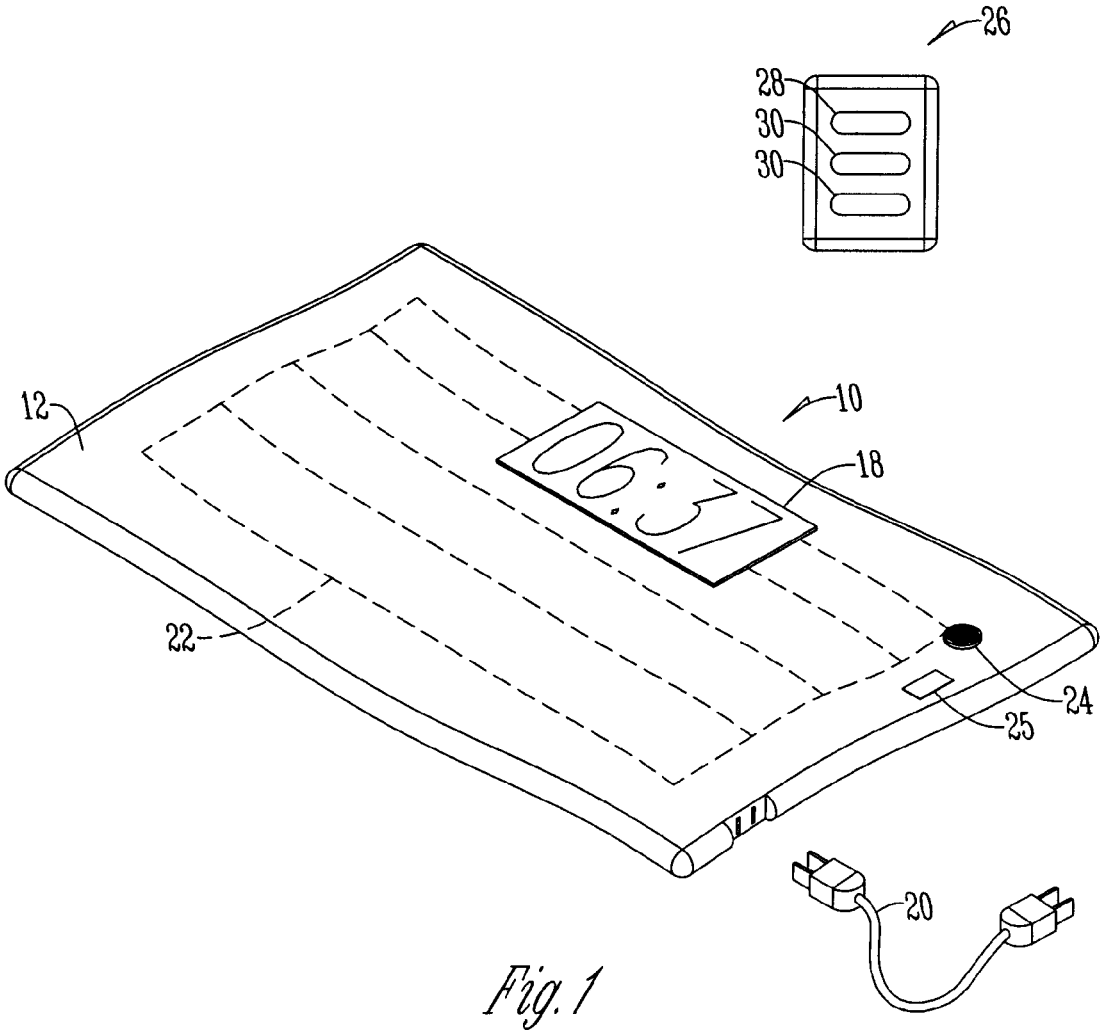
FIG. 1 is a top perspective view and a side view of the present invention.
Figure 2:
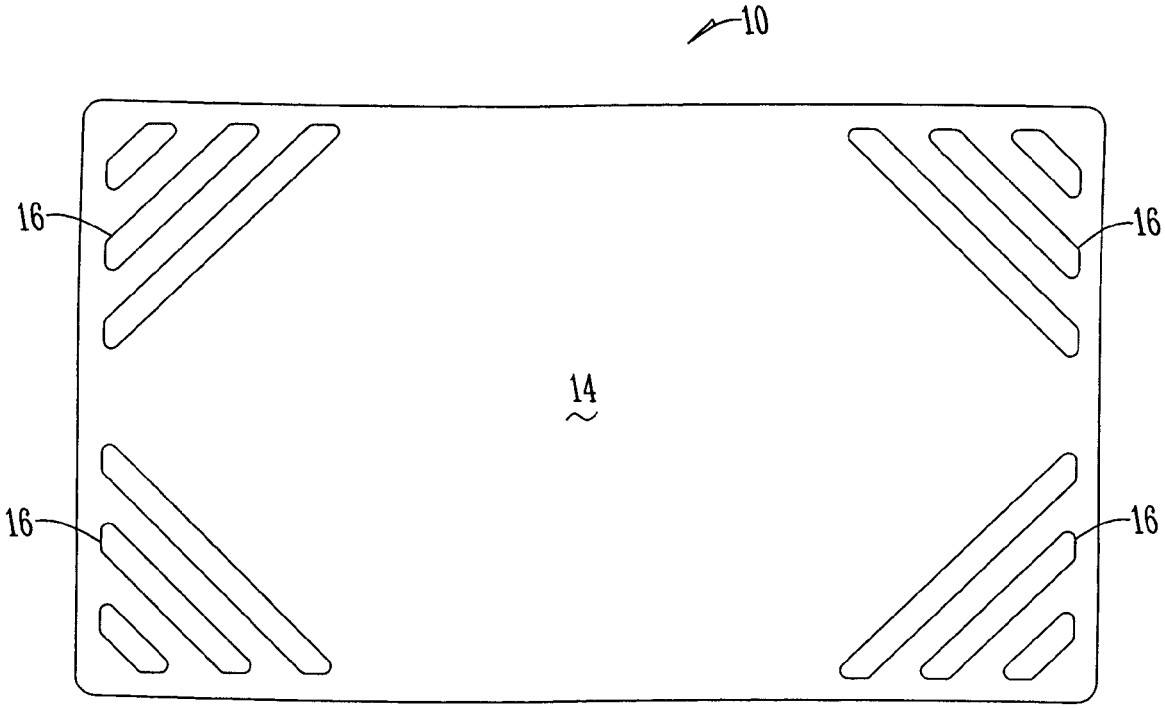
FIG. 2 is a bottom view of the present invention.

Referring to the Figures a mat 10 having a top surface 12 and a bottom surface 14 is used in affecting the development of the child. Preferably, the mat 10 is made of a washable material and has a gripping portion 16, such as a rubber strip, on the bottom surface 14. The mat 10 is used in many ways including placement on the floor, counter or chair, or hung from a wall or shelf.

Electrically connected to the mat 10 is a timing device 18. The timing device 18 has a display, such as an LCD, that displays the time remaining for a designated activity. The display preferably shows digital numbers, but could be of other formations such as a digital bar that gets smaller as time elapses or adds smiley faces. The timing device 18 is rechargeable or alternatively connected to a power source 20.

Further connected to the timing device 18 is a process controller 25 that is electrically connected to a sensor 22 and a speaker 24. The sensor 22 is embedded within the mat 10 such that it senses pressure when pressure is applied to the mat 10. The speaker 24 emits audio sound stored in the controller 25 including music, a recorded message, or a warning signal such as a buzzer.

Connected either electrically or through a wireless connection is a remote control device 26. The remote control device 26 has an on/off switch 28 that activates the controller 25 which in turn activates the timing device 18. The remote control device 26 has additional buttons 30 that are used to set/adjust a determined amount of time, activate music, and record a message. In one embodiment the remote control device 26 has a magnetic strip for removable attachment to a metal object such as a refrigerator.

In operation the timing device 18 and mat 10 are activated engaging the on switch 28 on the remote control device 26. Alternatively, all operational buttons may be mounted to the timer 18. Once activated, an operator, using buttons 30 on the remote control device 26 sets a desired time increment. When a child steps or sits on the mat 10 the sensor 22 sends a signal to the controller 25 indicating that pressure has been applied. The controller 25 in turn sends a signal to activate the timing device 18 such that the remaining time on the timer 18 decreases. Optionally, by engaging a switch either on the mat 10 or the remote control device 26, music stored in the controller 25 will play through the speakers 24 as the timer 18 runs. The music will play a melody while pressure is applied and the timer 18 is running to help sooth the child and provide a calming effect.

If, while the timer 18 is running, the sensor 22 does not detect pressure (i.e., a child steps off the mat 10) a signal is sent to the controller 25 which in turn sends a signal to the timer 18 resetting the timer to the originally set time. Optionally, when no pressure is detected, the controller 25 sends a signal activating an audio warning such as a buzzer or a bell.

When the timer 18 has run for the full set time, the controller 25 will send a signal activating an audio signal such as an alarm. Alternatively, the caregiver may record a message of choice that is stored in the controller 25 and played when the set time has expired.

What is claimed is:

1. A child management system, comprising:

a mat having a top and bottom surface;

a timing device mounted on the mat, and a pressure sensitive sensor embedded within the mat electronically connected to the timing device; and wherein a remote control device is connected to the timing device by a wireless connection to set a pre-determined amount of time;

wherein a speaker is mounted on the mat and is electronically connected to the sensor;

wherein the remote control device has buttons to record a message wherein the recorded message is stored in a controller electronically connected to the sensor and the speaker and is played when the set pre-determined amount of time has expired.

2. The child management system of claim 1 further comprising a gripping portion on the bottom surface.

3. The child management system of claim 1 wherein the timing device has a display.

4. The child management system of claim 3 wherein the display is LCD.

* * * * *